US010815733B2

(12) United States Patent
Trunk

(10) Patent No.: US 10,815,733 B2
(45) Date of Patent: Oct. 27, 2020

(54) UNDERREAMER CUTTER BLOCK

(71) Applicant: Schlumberger Technology Corporation, Sugar Land, TX (US)

(72) Inventor: Philip G. Trunk, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 37 days.

(21) Appl. No.: 15/770,527

(22) PCT Filed: Oct. 27, 2016

(86) PCT No.: PCT/US2016/058964

§ 371 (c)(1),
(2) Date: Apr. 24, 2018

(87) PCT Pub. No.: WO2017/075117

PCT Pub. Date: May 4, 2017

(65) Prior Publication Data

US 2019/0055786 A1 Feb. 21, 2019

Related U.S. Application Data

(60) Provisional application No. 62/247,508, filed on Oct. 28, 2015.

(51) Int. Cl.

| | |
|---|---|
| ***E21B 10/32*** | (2006.01) |
| ***E21B 10/567*** | (2006.01) |
| ***E21B 17/10*** | (2006.01) |
| ***E21B 7/28*** | (2006.01) |

(52) U.S. Cl.
CPC ..... *E21B 10/322* (2013.01); *E21B 10/325* (2013.01); *E21B 10/567* (2013.01); *E21B 17/1078* (2013.01); *E21B 7/28* (2013.01)

(58) Field of Classification Search
CPC ..... E21B 10/26; E21B 10/56; E21B 10/567
See application file for complete search history.

(56) References Cited

U.S. PATENT DOCUMENTS

| | | | | |
|---|---|---|---|---|
| 7,661,489 | B2 | 2/2010 | Fyfe | |
| 9,074,434 | B2 | 7/2015 | Mensa-Wilmot | |
| 2010/0276201 | A1* | 11/2010 | Makkar | E21B 7/28 175/57 |
| 2012/0175168 | A1* | 7/2012 | Lee | E21B 10/322 175/57 |

(Continued)

OTHER PUBLICATIONS

International Preliminary Report on Patentability issued in International Patent Application No. PCT/US2016/058964, dated May 11, 2018, 11 pages.

(Continued)

*Primary Examiner* — David J Bagnell
*Assistant Examiner* — Dany E Akakpo

(57) ABSTRACT

A downhole cutting apparatus includes a cutter block. The cutter block includes a formation facing surface with cutting elements coupled thereto. The cutting elements are arranged in rows that may extend at an angle across a width of the formation facing surface. Mud flutes may optionally be located between rows of cutting elements. A gauge portion of the formation facing surface may be adjacent a leading edge having reinforcement members coupled thereto.

20 Claims, 8 Drawing Sheets

(56) References Cited

U.S. PATENT DOCUMENTS

| | | | | |
|---|---|---|---|---|
| 2013/0133954 | A1* | 5/2013 | Mohon | E21B 10/28 175/345 |
| 2014/0202770 | A1 | 7/2014 | Zaki et al. | |
| 2014/0305711 | A1 | 10/2014 | Downie et al. | |
| 2015/0285004 | A1 | 10/2015 | Makkar et al. | |

OTHER PUBLICATIONS

International Search Report and Written Opinion issued in International Patent Application No. PCT/US2016/058964 dated Feb. 3, 2017, 16 pages.

* cited by examiner

UNDERREAMER CUTTER BLOCK

CROSS-REFERENCE TO RELATED APPLICATIONS

This application is the U.S. national phase entry of International Patent Application No. PCT/US2016/058964, filed Oct. 27, 2016, which claims the benefit of, and priority to, U.S. Patent Application No. 62/247,508, filed Oct. 28, 2015, which application is expressly incorporated herein by this reference in its entirety.

BACKGROUND

In the drilling of oil and gas wells, concentric casing strings are installed and cemented in the wellbore as drilling progresses to increasing depths. Each new casing string may run from the surface or may include a liner suspended from a previously installed casing string. The new casing string may be within the previously installed casing string, thereby limiting the annular area available for the cementing operation. Further, as successively smaller diameter casing strings are used, the flow area for the production of oil and gas is reduced. To increase the annular space for the cementing operation, and to increase the production flow area, it may be desirable to enlarge the wellbore below the terminal end of the previously cased portion of the wellbore. By enlarging the wellbore, a larger annular area is provided for subsequently installing and cementing a larger casing string than would have been possible otherwise. Accordingly, by enlarging the wellbore below the previously cased portion of the wellbore, comparatively larger diameter casing may be used at increased depths, thereby providing more flow area for the production of oil and gas.

Various methods have been devised for passing a drilling assembly through an existing cased portion of a wellbore and enlarging the wellbore below the casing. One such method is the use of an underreamer, which has basically two operative states. A first state is a closed, retracted, or collapsed state, where the diameter of the tool is sufficiently small to allow the tool to pass through the existing cased portion of the wellbore. The second state is an open, active, or expanded state, where arms or cutter blocks extend from the body of the tool. In this second state, the underreamer enlarges the wellbore diameter as the tool is rotated and lowered and moved axially in the wellbore.

SUMMARY

According to some embodiments, a cutting apparatus includes a cutter block and cutting elements. The cutter block may define a formation facing surface, a leading edge, and a trailing edge. The cutting elements may be coupled to the formation facing surface of the cutter block and arrange din rows that are angled relative to the formation facing surface.

In accordance with further example embodiments of the present disclosure, a cutting apparatus includes a cutter block and cutting elements. The cutter block includes a formation facing surface, leading and trailing edges. At least one mud flute of the cutter block is formed in the formation facing surface and extends fully or partially between the leading and trailing edges. The cutting elements are coupled to the formation facing surface and extend therefrom. The cutting elements may include non-planar cutting elements offset from the leading edge.

Additional example embodiments of the present disclosure include a cutting apparatus with a cutter block and reinforcement members. The cutter block includes a leading side surface and a formation facing surface. The formation facing surface defines a gauge portion and at least one reaming portion. The reinforcement members are coupled to the leading side surface of the cutter block at a cutting edge adjacent the formation facing surface.

Another downhole cutting apparatus includes a cutter block, cutting elements, and a reinforcement member. The cutter block includes a formation facing surface, opposing leading and trailing edges on opposing sides of the formation facing surface, and angled mud flutes in the formation facing surface. The angled mud flutes extend between the leading and trailing edges of the cutter block. The cutting elements are coupled to the formation facing surface and are arranged in at least one angled row. The reinforcement member is coupled to the leading edge and aligned with a gauge portion of the formation facing surface.

A method for enlarging a wellbore includes tripping a downhole cutting apparatus into a wellbore. The downhole cutting apparatus may include cutter blocks with angled rows of cutting elements on a formation facing surface, angled mud flutes in the formation facing surface, a reinforced cutting edge, or any combination of the foregoing. The downhole cutting apparatus can be rotated to cause cutting elements to cut or degrade formation around the wellbore.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

FIGS. 2-1 and 2-2 are partial cut-away views of an underreamer, in accordance with embodiments disclosed herein.

FIG. 3-1 is a perspective view of a cutter block, in accordance with embodiments disclosed herein.

FIG. 3-2 is a side view of the cutter block of FIG. 3-1.

FIG. 3-3 is a top view of the cutter block of FIG. 3-1.

FIG. 8-1 is a perspective view of a ridge cutting element, in accordance with embodiments disclosed herein.

FIG. 8-2 is a side view of the ridge cutting element of FIG. 8-1.

FIGS. 10-1 to 10-3 are side views of cutting elements at varying back rake angles, in accordance with embodiments disclosed herein.

FIGS. 12-1 to 13-3 are various views of cutting elements having varying side rake angles, in accordance with embodiments disclosed herein.

DETAILED DESCRIPTION

In some aspects, embodiments disclosed herein relate generally to cutting structures for use on drilling tool assemblies. More specifically, some embodiments disclosed herein relate to cutting structures for an underreamer or other tool used to enlarge a previously existing wellbore.

According to some aspects of the disclosure, there is provided a downhole cutting apparatus, such as an underreamer, which may include a cutter block having a longitudinal axis defined therethrough. The cutter block may have an underreaming portion or edge and a backreaming portion or edge. In one or more embodiments, the downhole cutting apparatus may be an expandable tool and the cutter block may be radially extendable from a tubular body of the expandable tool. In one or more other embodiments, the downhole cutting apparatus may be a downhole cutting tool that is not expandable. For example, in one or more embodiments, the downhole cutting apparatus may be a hole opener having a fixed cutter block.

Figure 1:
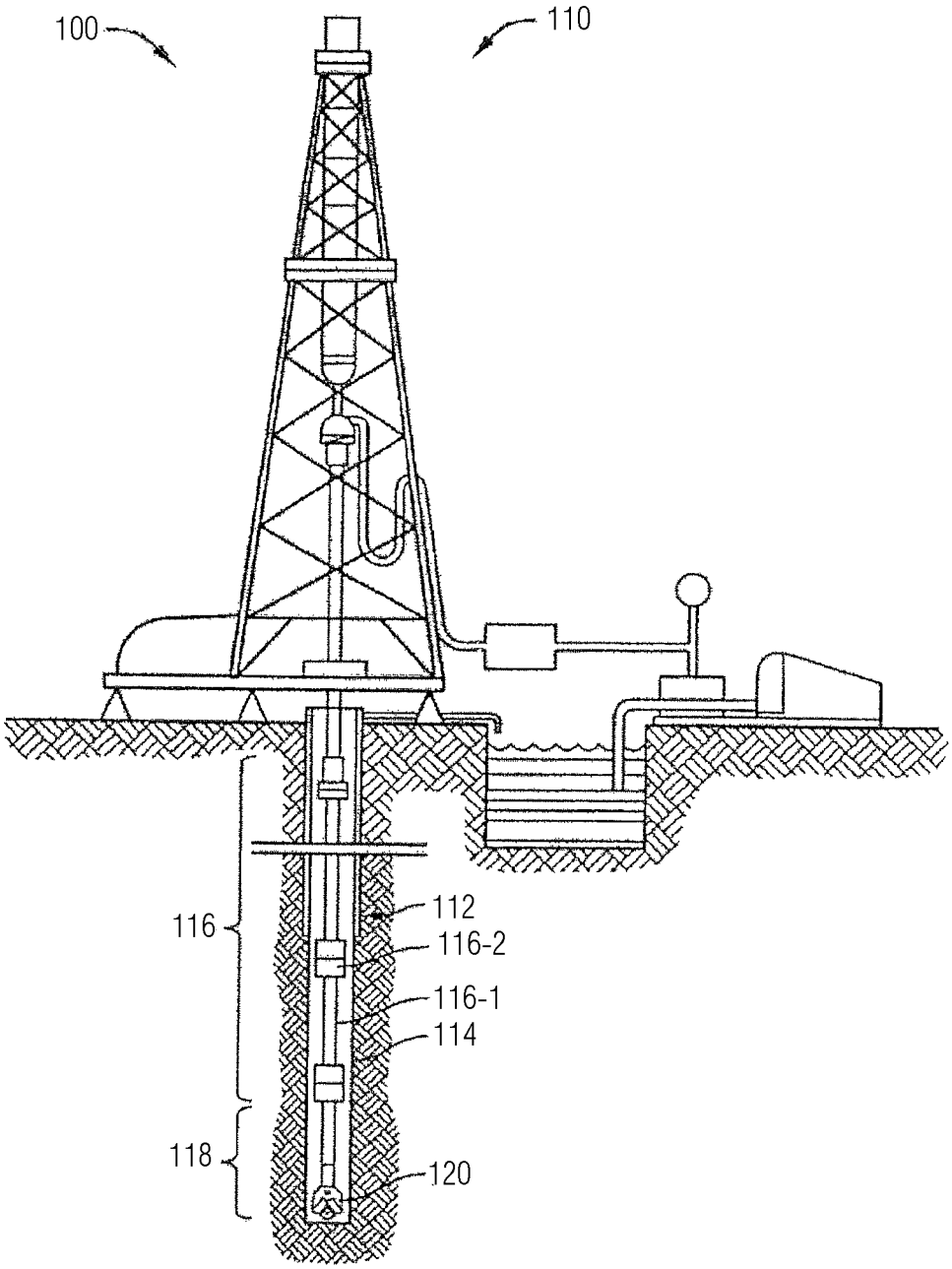
FIG. 1 is a schematic representation of a drilling operation.

Referring now to FIG. 1, one example of a system for drilling an earth formation is shown. The drilling system 100 includes a drilling rig 110 used to turn a drilling tool assembly 112 that extends into a wellbore 114. The drilling tool assembly 112 includes a drill string 116, and a bottom-hole assembly ("BHA") 118 attached to a distal end portion of the drill string 116. The distal end portion of the drill string 116 is the portion furthest from the drilling rig 110.

The drill string 116 includes several joints of drill pipe 116-1 connected end-to-end through tool joints 116-2. The drill string 116 is used to transmit drilling fluid (e.g., through a bore extending through hollow tubular members) and to transmit rotational power from the drilling rig 110 to the BHA 118. In some embodiments the drill string 116 further includes additional components such as subs, pup joints, valves, actuation assemblies, etc.

The BHA 118 in FIG. 1 includes a drill bit 120. A BHA may also include additional components attached between the drill string 116 and the drill bit 120. Examples of additional BHA components include drill collars, stabilizers, measurement-while-drilling (MWD) tools, logging-while-drilling (LWD) tools, subs, hole enlargement devices (e.g., hole openers and reamers), jars, thrusters, downhole motors, and rotary steerable systems.

Figures 1, 2:
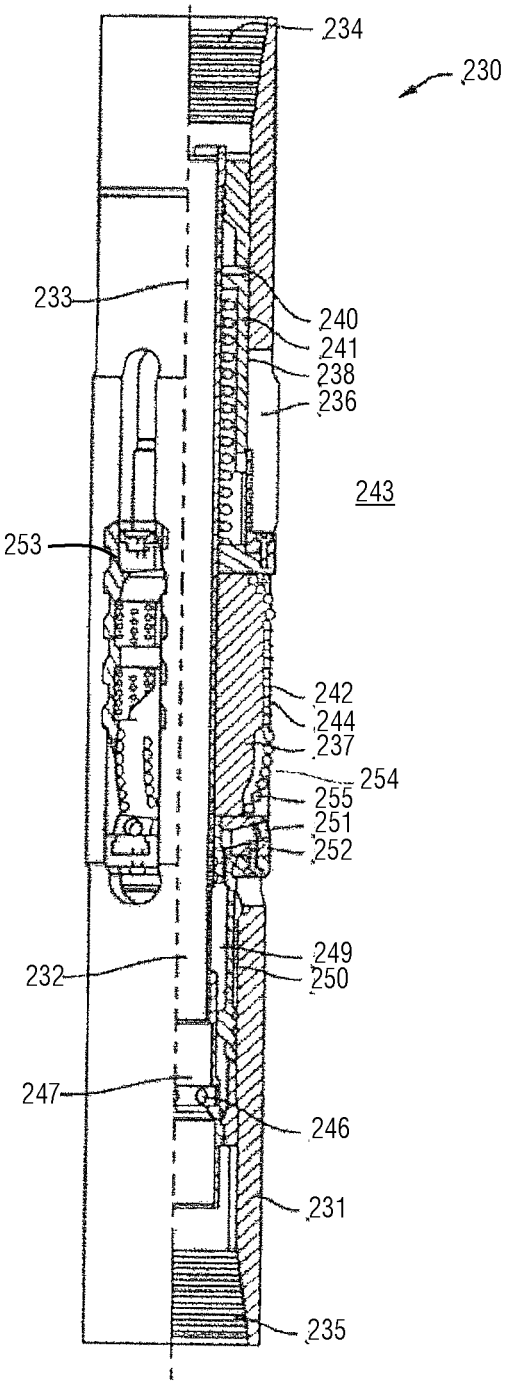
Figure 2:
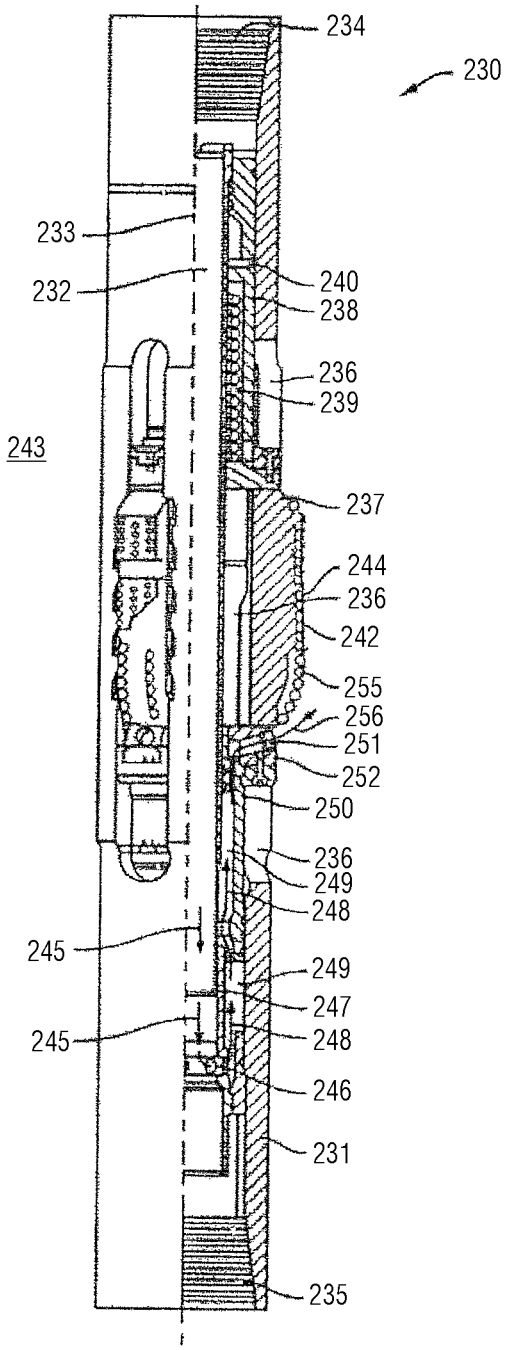

Referring to FIGS. 2-1 and 2-2, an expandable tool, which may be used in embodiments of the present disclosure, generally designated as underreamer 230, is shown in a collapsed position in FIG. 2-1 and in an expanded position in FIG. 2-2. The underreamer 230 may include a generally cylindrical tubular tool body 231 with a flowbore 232 extending fully or partially therethrough along a longitudinal axis 233 of the underreamer 230. As shown, the tool body 231 may include an upper connection portion 234 and a lower connection portion 235 for coupling the underreamer 230 to a drill string, BHA, or other drilling assembly. Further, as shown, one or more recesses 236 may be formed in the tool body 231, and optionally at approximately the axial center of the tool body 231. The one or more recesses 236 may be spaced apart azimuthally around the circumference of the tool body 231. The one or more recesses 236 may accommodate the axial movement of several components of the underreamer 230 that move axially up or down within the recesses 236, including one or more moveable tool arms, such as cutter blocks 237. The cutter blocks 237 may be non-pivotable in some embodiments, but movable tool arms or cuter blocks may pivot in other embodiments. Each recess 236 may store one or more cutter blocks 237 in the collapsed position.

FIG. 2-2 shows the underreamer 230 with the cutter blocks 237 in an expanded position (e.g., a maximum expanded position), extending radially outwardly from the tool body 231. Once the underreamer 230 is in the wellbore, one or more of the cutter blocks 237 may be expandable to one or more radial positions. The underreamer 230 may therefore have at least two operational positions—including at least a collapsed position as shown in FIG. 2-1 and an expanded position as shown in FIG. 2-2. In other embodiments, the underreamer 230 may have multiple operational positions where the cutter blocks 237 are between fully retracted and fully expanded states. In some embodiments, a spring retainer 238, which may include a threaded sleeve, may be adjusted at the surface or using a downhole drive system, to limit the full diameter expansion of the cutter blocks 237. The spring retainer 238 may compress a biasing spring 239 when the underreamer 230 is collapsed, and the position of the spring retainer 238 may determine the amount of expansion of the cutter blocks 237. The spring retainer 238 may be adjusted by a wrench (not shown) in a wrench slot 240 that may rotate the spring retainer 238 axially downwardly or upwardly with respect to the tool body 231 at the threads 241.

In the expanded position shown in FIG. 2-2, the cutter blocks 237 may perform one or more of underreaming the wellbore, backreaming the wellbore, or stabilizing the drilling assembly within the wellbore. The operations performed may depend on the configuration of the cutter blocks 237, including one or more pads 242 and other surfaces. In some embodiments, the cutter blocks 237 may have configurations as further discussed herein. Hydraulic force within the underreamer 230 may cause the cutter blocks 237 to expand radially outwardly (and optionally to move axially upwardly) to the position shown in FIG. 2-2 due to the differential pressure of the drilling fluid between the flowbore 232 and the wellbore annulus 243.

In one or more embodiments, optional depth of cut limiters 244 on pad 242 may be formed from polycrystalline diamond, tungsten carbide, titanium carbide, cubic boron nitride, other superhard materials, or some combination of the foregoing. Depth of cut limiters 244 may include inserts with cutting capacity, such as back-up cutting elements or cutters, diamond impregnated inserts with less exposure than primary cutting elements, diamond enhanced inserts, tungsten carbide inserts, semi-round top inserts, or other inserts that may or may not have a designated cutting capacity. Optionally, the depth of cut limiters 244 may not primarily engage formation during reaming; however, after wear of primary cutting elements, depth of cut limiters 244 may engage the formation to protect the primary cutting elements from increased loads as a result of worn primary cutting elements. In one or more embodiments, depth of cut limiters 244 may be positioned above or uphole from primary cutting elements on a shoulder of the cutter block 237. The distance from the primary cutting elements may be selected such that depth of cut limiters 244 may remain largely unengaged with formation until wear of other cutting elements occurs. Depth of cut limiters 244 may aid in maintaining a desired wellbore gauge by providing increased structural integrity to the cutter block 237.

Drilling fluid may flow along path 245, through ports 246 in a lower retainer 247, along path 248 into a piston chamber 249. A differential pressure between fluid in the flowbore 232 and the fluid in the wellbore annulus 243 surrounding the underreamer 230 may cause the piston 250 to move axially upwardly from the position shown in FIG. 2-1 to the position shown in FIG. 2-2. A small amount of flow can move through the piston chamber 249 and through nozzles 251 to the wellbore annulus 243 as the cutter blocks 237 of the underreamer 230 start to expand. As the piston 250 moves axially upwardly in recesses 236, the piston 250 engages a drive ring 252, thereby causing the drive ring 252 to move axially upwardly against the cutter blocks 237. The cutter blocks 237 will move axially upwardly in recesses 236 and radially outwardly as the cutter blocks 237 travel in or along channels or splines 253 in or on the tool body 231. In the expanded position, the flow continues along paths 245, 248 and out into the wellbore annulus 243 through nozzles 251. The nozzles 251 may be part of the drive ring 252, and may therefore move axially with the cutter blocks 237. Accordingly, these nozzles 251 are optimally positioned to continuously provide cleaning and cooling to cutting elements 255 on surface(s) 254 as fluid exits to the wellbore annulus 243 along flow path 256.

The underreamer 230 may be designed to remain generally concentric with the wellbore. In particular, underreamer 230, in one embodiment, may include three extendable cutter blocks 237 spaced apart circumferentially at the same axial location on the tool body 231. In some embodiments, the circumferential spacing may be approximately 120°. This three-arm design may provide a full gauge underreamer 230 that remains centralized in the wellbore. Embodiments disclosed herein are not limited to tool embodiments having three extendable cutter blocks 237. For example, in one or more embodiments, the underreamer 230 may include different configurations of circumferentially spaced cutter blocks or other types of arms, for example, one arm, two arms, four arms, five arms, or more than five arm designs. Thus, in some embodiments, the circumferential spacing of the arms may vary from the 120° spacing described herein. For example, in other embodiments, the circumferential spacing may be 90°, 60°, or the cutter blocks 237 may be circumferentially spaced in non-equal increments. Further, in some embodiments, one or more of the cutter blocks 237 may be axially offset from one or more other cutter blocks 237. Accordingly, the cutting structure designs disclosed herein may be used with any number of cutting structures and tools.

Figures 1, 3:
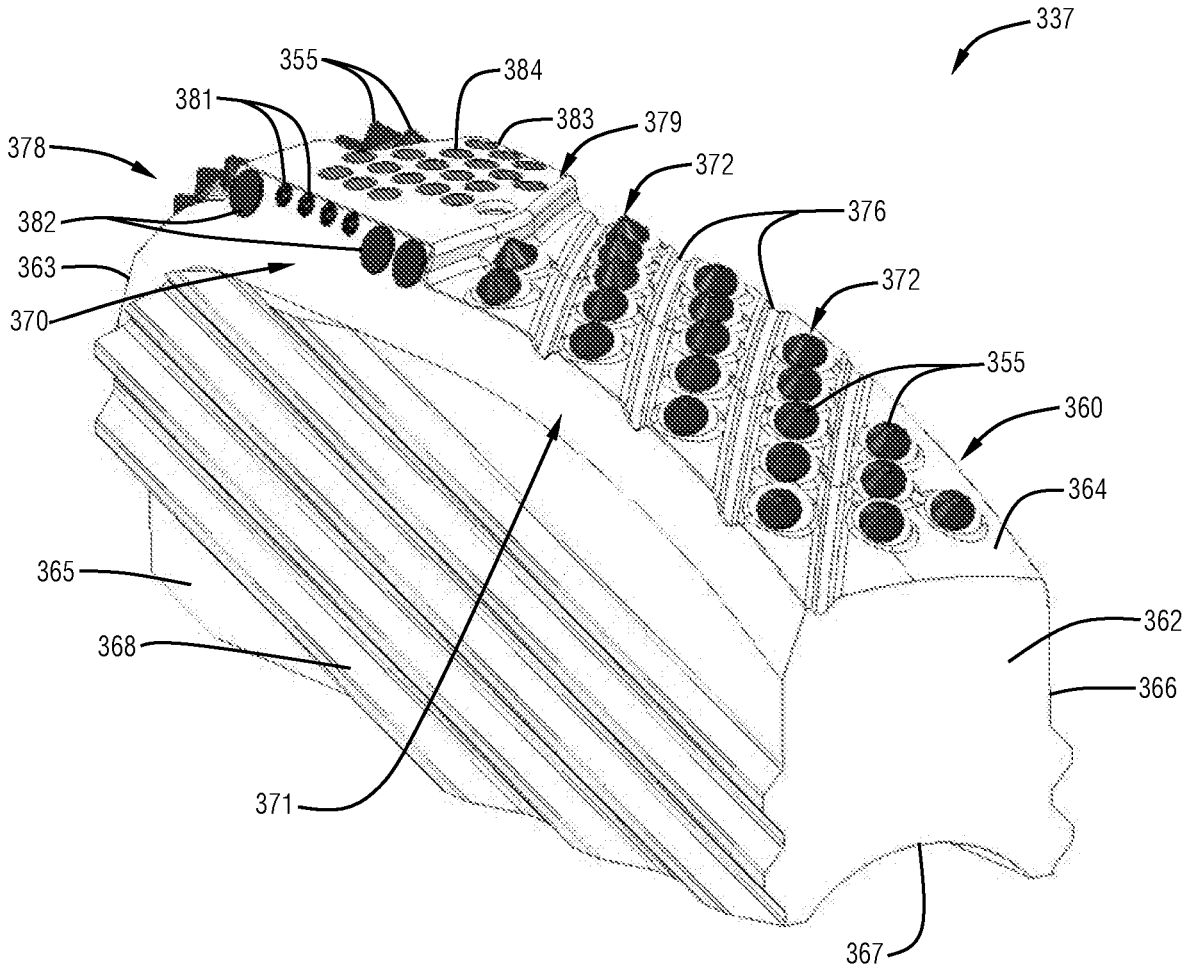
Figures 2, 3:
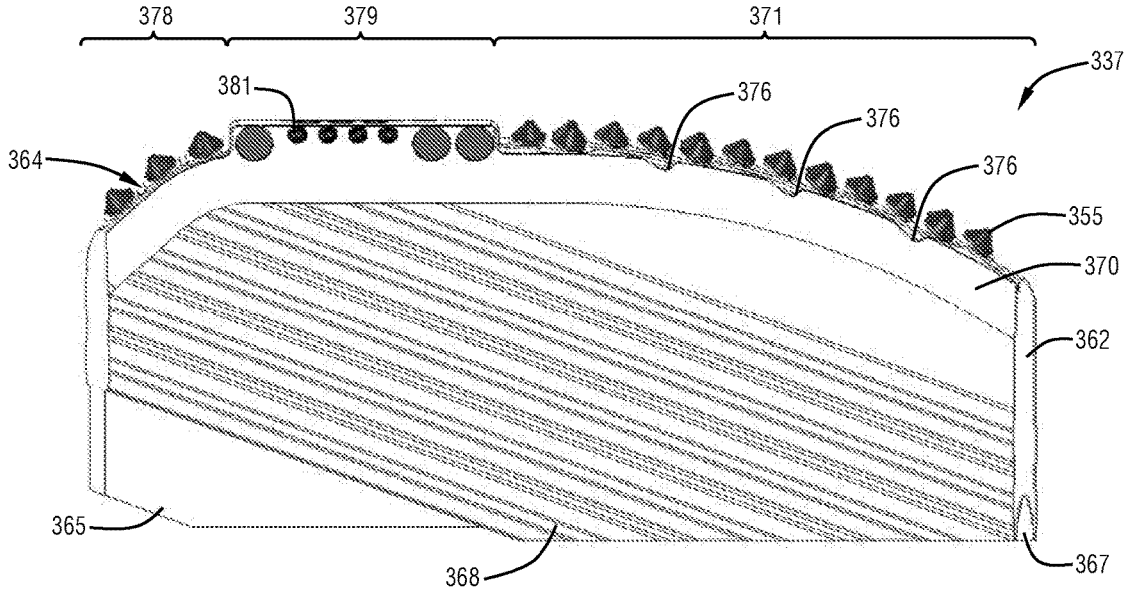
Figure 3:
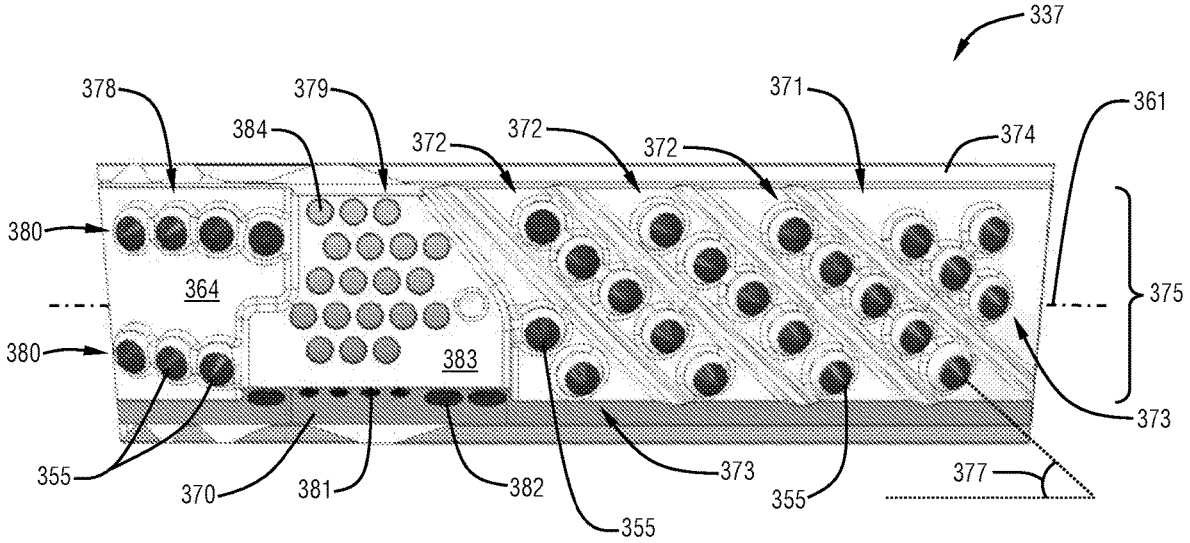

For example, FIGS. 3-1 to 3-3 illustrate various views of a cutter bock 337 in accordance with embodiments described herein. As shown, the cutter block 337 may include a body 360 having a longitudinal axis 361. The cutter block 337 may further include a downhole end 362 and an uphole end 363. The body 360 of the cutter block 337 may further include or define a formation facing surface 364 arranged to abut, engage, or be positioned against or toward the formation within a wellbore. The cutter block 337 may be rotated in the wellbore, and the body 360 may define a leading side surface 365 facing the direction of rotation, and a trailing side surface 366 facing away from the direction of rotation. The formation facing surface 364 may generally extend laterally between the leading and trailing side surfaces 365, 366 and longitudinally in the direction of the longitudinal axis 361. A bottom surface 367 may also extend laterally between the leading and trailing side surfaces 365, 366 and longitudinally in the direction of the longitudinal axis 361, but may face away from the formation. In some embodiments, one or more splines or channels (collectively designated splines 368) may be formed on one or more of the leading or trailing side surfaces 365, 366 and used in selectively expanding or retracting the cutter block 337. For instance, the splines 368 may engage corresponding splines of a reamer body (e.g., splines 253 in FIG. 2-1), which may direct the cutter block 337 as it moves axially/longitudinally between radially expanded and radially retracted positions.

In one or more embodiments, the body 360 may be formed from a metal material, a matrix material, other materials, or a combination of the foregoing. For instance, the body 360 may be formed of or include steel, tungsten carbide, titanium carbide, or any other material known in the art. The cutter block 357 may be configured to be coupled to a downhole tool (e.g., the underreamer 230 shown in FIGS. 2-1 and 2-2). In one or more embodiments, the downhole end 362 of the cutter block 357 may be further downhole than the uphole end 363 of the cutter block 357 when the cutter block 357 is coupled to the downhole tool and within a wellbore. In one or more embodiments, the cutter block 357 may have a plurality of cutting elements 355 on, in, or otherwise coupled to the formation facing surface 364 of the body 360. One or more cutting elements (e.g., reinforcement members 382) may also be on, in, or otherwise coupled to a leading edge 370 of the leading side surface 365 of the body 360 in some embodiments. In one or more embodiments, the cutting elements 355 and/or reinforcement members 382 may be formed from tungsten carbide, polycrystalline diamond, cubic boron nitride, other materials, or any combination of the foregoing. In some embodiments, cutting elements, reinforcement members, gauge protection elements, or other components may be welded, brazed, bonded, adhered, press fit, or otherwise coupled to the body 360 (e.g., brazed within respective pockets formed in the body 360). In further examples, cutting elements, reinforcement members, gauge protection elements may be coupled to the body 360 by being integrally formed therewith.

As shown, the cutting elements 355 coupled to the formation facing surface 364 and within an underreaming portion 371 of the body 360 may be arranged in one or more rows 372. In this particular embodiment, for instance, and as shown in FIG. 3-3, the underreaming portion 371 is shown as including three rows 372 extending substantial portions of the width of the formation facing surface 364 of the cutter block 337 (i.e., from the leading side surface 365 to the trailing side surface 366). Such rows 372 are illustrated as including five cutting elements 355 extending in a generally linear direction. In some embodiments, the length of a row 372 (i.e., the length of a line extending between furthest points on cutting elements 355 on opposing ends of a row 372) may extend a substantial portion of the width of the formation facing surface 364 when extending between 65% and 95% of an effective width of the formation facing surface 364 at the corresponding location of the row 372. The effective width of the formation facing surface 364 may be based on the orientation of the row 372. For instance, where the row 372 is about perpendicular to the longitudinal axis 361, the effective width of the formation facing surface 364 may be equal to a length of a line between the trailing edge 374 and the leading edge 370, which is the width 375 of the formation facing surface 364 in FIG. 3-3. Where the row 372 is not perpendicular to the longitudinal axis 361, the effective width of the formation facing surface 364 may be equal to the length of a line between the trailing edge 374 and the leading edge 370 and which is oriented at an angle parallel to the row 372. For instance, the effective width may be about equal to a length of a mud flute 376 oriented to be about parallel to a row 372 of cutting elements 355. According to at least some embodiments, the length of a row 372 of cutting elements 355 may be between 65% and 85%, between 75% and 82%, or between 80% and 85% of the effective width of a corresponding location of the formation facing surface 364. In other embodiments, the length of a full row 372 may be less than 65% or greater than 95% of an effective width of a formation facing surface 364.

In FIGS. 3-1 to 3-3, for instance, in addition to rows 372 that are substantially the full width of the formation facing surface 364, there may be one or more additional rows 373 that are partial rows of fewer cutting elements 355 or which extend less than substantially the full width of the formation facing surface 364. For instance, rows 373 of two or three cutting elements 355 may, in some embodiments, be between 15% and 65% of the effective width of the formation facing surface 364. More particularly, one or more of the rows 373 may be between 25% and 45%, between 20% and 30%, between 35% and 45%, or between 40% and 55% of the effective width of the formation facing surface 364 at a corresponding location. In other embodiments, the rows 373 may have a length less than 15% or more than 65% of the effective width of the formation facing surface 364. While the lengths of rows 372, 373 are discussed relative to an effective width of a formation facing surface 364 at a corresponding location of the rows 372, 373, in other embodiments the same percentages may be applied to a maximum effective width of the formation facing surface 364.

The particular orientation of the rows 372, 373 may be changed to accommodate different cutter block designs as used for different applications, wellbore conditions, formation properties, and the like. For instance, in some embodiments, each of the rows 372 and/or rows 373 may be oriented to be about parallel to each other, or they may be inclined and non-parallel. In some embodiments, the rows 372 and/or the rows 373 may be offset at an angle 377 relative to the longitudinal axis 361 (or a line parallel to the longitudinal axis 361 as shown in FIG. 3-3). The angle 377 may be between 0° and 90° in some embodiments, for instance, the angle 377 may be within a range having lower and/or upper limits including any of 0°, 5°, 15°, 25°, 35°, 40°, 45°, 50°, 60°, 70°, 80°, 90°, or any values therebetween. For instance, in some embodiments, the angle 377 may be less than 50°, greater than 35°, between 15° and 60°, between 35° and 50°, or between 42.5° and 47.5°. In other embodiments, while the rows 372, 373 are shown as being angled in an upward direction (i.e., a cutting element 355 nearer the leading edge 370 is downhole of a cutting element 355 nearer the trailing edge 374), in other embodiments the angle 377 may be in a downhole direction and between 90° and 180° relative to the line shown in FIG. 3-3.

It should further be appreciated that while the cutting elements 355 may be generally linear, there may be some offsets so that they are not all centered directly on a line. For instance, in FIG. 3-3, the first three cutting elements 355 of a row 372 (i.e., nearest the leading edge 370) may be centered on the same line, but the last two cutting elements 355 (i.e., nearest the trailing edge 374) may be slightly offset, and may even potentially define a curved line through the centers of each cutting element 355. Nevertheless, the cutting elements 355 of a single row 372 may remain substantially linear as the last cutting elements 355 may overlap the line through centers of the first cutting elements 355. In another embodiment, the cutting elements 355 of a row 372 may be substantially linear where middle cutting elements 355 overlap a line between centers of first and last cutting elements 355.

As further shown in FIGS. 3-1 to 3-3, a cutter block 337 may include different portions, including one or more of an underreaming portion 371, a backreaming portion 378, or a gauge portion 379. The gauge portion 379 may be configured to define the size of the wellbore as enlarged by the cutter blocks 337, and the underreaming portion 371 and/or backreaming portion 378 may taper from the gauge portion 379 to a reduced size or radial position.

The underreaming portion 371 may include the cutting elements 355 arranged in the rows 372, 373 as discussed herein. In some embodiments, the backreaming portion 378 may also include cutting elements 355 arranged in similar rows, and thus may be oriented between 0° and 90° as discussed previously. In other embodiments, however, rows 380 of cutting elements 355 of the backreaming portion 378 may be arranged or designed to be different than the rows 372, 373 of the underreaming portion 371. In FIG. 3-3, for instance, the rows 372, 373 on the underreaming portion 371 may be oriented at an angle 377 of about 45° while the rows 380 may be oriented to be at an angle between 0° and 25°. For instance, an angle of one or more of the rows 380 relative to the longitudinal axis 361 (or a line parallel to the longitudinal axis 361) may be between 0° and 15°, between 0° and 10°, or between 5° and 20°. In other embodiments, the angle of one or more of the rows 380 may be greater than 25°. In some embodiments, the rows 380 may be about parallel to the longitudinal axis 361 or each other and offset from each other a distance that is perpendicular to the longitudinal axis 361. In further example embodiments, a single row 380 of cutting elements 355 may be located on the backreaming portion 378 or more than two rows 380 may be located on the backreaming portion 378.

FIGS. 3-1 to 3-3 further illustrate an example embodiment in which one or more mud flutes 376 may be positioned on the underreaming portion 371 of the formation facing surface 364 of the cutter block 337. The mud flutes 376 may include interrupted or continuous grooves or slots in the formation facing surface 364 that allow drilling fluid, cuttings, or other materials to flow along the formation facing surface 364. In particular, the mud flutes 376 may allow materials to flow or move between cutting elements 355 and/or in an axial direction relative to the cutting block 355.

In at least some embodiments, the mud flutes 376 may extend a full width (or effective width) of the formation facing surface 364. Further, the mud flutes 376 may be oriented at any number of different angles relative to the longitudinal axis 361. For instance, the mud flutes 376 may be oriented to be about parallel to one or more rows 372, 373 of cutting elements 355, and optionally between rows 372, 373 of cutting elements 355. Thus, in some embodiments, an angle of the mud flutes 376 may be between 0° and 90° angle relative to the longitudinal axis 361. More particularly, the angle of the mud flutes 377 may be within a range having lower and/or upper limits including any of 0°, 5°, 15°, 25°, 35°, 40°, 45°, 50°, 60°, 70°, 80°, 90°, or any values therebetween. For instance, in some embodiments, the angle of the mud flutes 376 may be less than 50°, greater than 35°, between 15° and 60°, between 35° and 50°, or between 42.5° and 47.5°. In other embodiments, while the mud flutes 376 are shown as being angled in an upward direction (i.e., in an uphole direction from the leading edge 370 toward the trailing edge 374), in other embodiments the mud flutes 376 may be oriented in a downhole direction and at an angle that is between 90° and 180° relative to the longitudinal axis 361. While not shown in FIGS. 3-1 to 3-3, the backreaming portion 378 may also include one or more mud flutes in some embodiments. Also, while mud flutes 376 are shown as being located adjacent both uphole and downhole sides of the full rows 372 of cutting elements 355, such an embodiment is merely illustrative. In other embodiments, for instance, one or more mud flutes 376 may be omitted. Further, mud flutes 376 may be included on one or more sides of a partial row 373 of cutting elements 355.

According to some further example embodiments, the cutter block 337 may also include edge protection or reinforcement in at least some embodiments of the present disclosure. For instance, FIGS. 3-1 to 3-3 illustrate additional example reinforcement members 381, 382 that may be in, on, or otherwise coupled to the leading edge 370 of the cutter block 337. More particularly, as shown in FIG. 3-2, the reinforcement members 381, 382 are optionally located on the leading edge 370 at or near the interface between the leading side surface 365 and the formation facing surface 364. The reinforcement members 381, 382 may be arranged, designed, or otherwise configured to restrict or even prevent wear of the body 360 along the leading edge 370. For instance, as the cutter block 337 is used to cut or degrade formation in a wellbore, the formation may contact the reinforcement members 381, 382 which may be slightly raised relative to the surface of the leading edge 370. The reinforcement members 381, 382 may be formed from polycrystalline diamond, tungsten carbide, titanium carbide, cubic boron nitride, other superhard materials, or some combination of the foregoing. In some embodiments, the reinforcement members 381, 382 have higher wear resistance properties than the materials of the body 360 (e.g., steel). The reinforcement members 381, 382 may include diamond enhanced inserts, diamond impregnated inserts, tungsten carbide inserts, semi-round top inserts, inserts with cutting capacity, other inserts or elements, or combinations of the foregoing. For instance, the reinforcement members 381 may include diamond enhanced inserts with a rounded outer surface, while the reinforcement members 382 may include shear cutting elements or cutters oriented for providing primarily wear reinforcement or protection capabilities.

In some embodiments, the reinforcement of the leading edge 370 may be positioned to be adjacent or aligned with a gauge portion 379 of the cutter block 337. For instance, the gauge portion 379 may include a gauge pad or stabilizer pad 383 on the formation facing surface 364. The stabilizer pad 364 optionally includes one or more gauge protection elements 384. The gauge protection elements 384 may be arranged, designed, or otherwise configured to restrict or even prevent wear of the body 360 on the stabilizer pad 383. For instance, as the cutter block 337 is used to cut or degrade formation in a wellbore, the formation may contact the gauge protection elements 384. The gauge protection elements 384 may be formed from polycrystalline diamond, tungsten carbide, titanium carbide, cubic boron nitride, other superhard materials, or some combination of the foregoing. In some embodiments, the gauge protection elements 384 have higher wear resistance properties than the materials of the body 360 (e.g., steel), and thus limit the amount of wear of the body 360. The gauge protection elements 384 may include diamond enhanced inserts, diamond impregnated inserts, tungsten carbide inserts, semi-round top inserts, inserts with cutting capacity, other inserts or elements, or combinations of the foregoing. For instance, the gauge protection elements 384 may include tungsten carbide inserts.

The reinforcement members 381, 382 are, in FIGS. 3-1 to 3-3 positioned on the leading edge 370 and adjacent the stabilizer pad 383 of the cutter block 373. In other embodiments, however, the reinforcement members 381, 382 may be positioned on additional or different portions of the leading edge 370 (e.g., adjacent underreaming portion 371 or backreaming portion 378). In at least some embodiments, the leading edge 370 may taper outwardly from the formation facing surface 364 to the leading side surface 365. The trailing edge 374 may also taper outwardly from the formation facing surface 364 to the trialing side surface 366.

The stabilizer pad 383 may have a uniform length across the width 375 of the formation facing surface 364, or the length may vary as shown in FIG. 3-3. In particular, the length of the stabilizer pad 383 is illustrated as being larger at the leading edge 370 than at the trailing edge 374, although such embodiment is merely illustrative. In other embodiments, the stabilizer pad 383 may have a larger length at the trailing edge 374 and/or intermediate position than at the leading edge 370. Further, while the stabilizer pad 383 is shown to be asymmetric, in other embodiments the stabilizer pad 383 may be symmetric along one or more axes.

Figure 4:
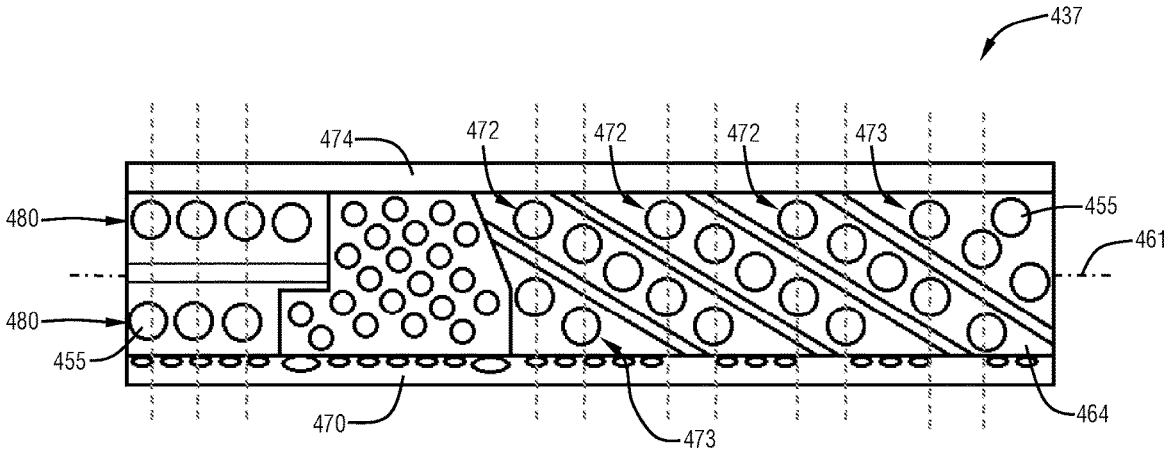
FIG. 4 is a top view of another cutter block, in accordance with embodiments disclosed herein.

Turning now to FIG. 4, a top view of another example cutter block 437 is shown in in accordance with some embodiments of the present disclosure. The cutter block 437 is shown along with positions of one or more cutting elements 455 in the formation facing surface 464 of the cutter block 437. The cutting elements 455 may be arranged in one or more rows 472, 473, 480 that may be angled or parallel relative to a longitudinal axis 461 of the cutter block 437.

Various dashed lines are also included in FIG. 4 to illustrate that various cutting elements 455 may be positioned in leading and back-up positions with respect to other cutting elements 455. In such an arrangement, a cutting element 455 nearer the leading edge 470 may be considered a leading cutting element and a longitudinally aligned cutting element 455 nearer the trailing edge 474 may be considered a back-up cutting element. One or more back-up cutting elements may be positioned on the cutter block 437 for some or each leading cutting element. In FIG. 4, for instance, some axial positions of cutting elements 455 include both leading and back-up cutting elements, whereas other positions may include a single cutting element. In at least some embodiments, a cutting element 455 nearer the trailing edge 474 may be positioned axially between to cutting elements 455 nearer the leading edge 470, and in an offset position rather than in a directly trailing or back-up position.

FIG. 4 illustrates a specific example in which angled rows 472, 473 of cutting elements 455 may provide at least one (e.g., two) back-up cutting elements for an uphole and adjacent row 472, 473. In other example embodiments, however, back-up cutting elements may not be oriented in rows, or may be included in a non-adjacent row. In still other embodiment, back-up cutting elements may not be positioned directly behind (i.e., at the same axial position) of a leading cutting element.

The term "cutting element" as used herein generically refers to any type of cutting element. Cutting elements may have a variety of configurations, and in some embodiments may have a planar cutting face (e.g., similar to reinforcement members 384 of FIGS. 3-1 to 3-3). "Non-planar cutting elements" will refer to those cutting elements having a non-planar cutting surface or end, such as a generally pointed cutting end ("pointed cutting element") or a generally conical cutting element having a crest or ridge cutting region ("ridge cutting element"), e.g., having a cutting end terminating in an apex, which may include cutting elements having a conical cutting end (shown in FIG. 5), a bullet cutting element (shown in FIG. 6), or a generally conical cutting element having a ridge (e.g., a crest or apex) extending across a full or partial diameter of the cutting element (shown in FIG. 8), for example.

Figure 5:
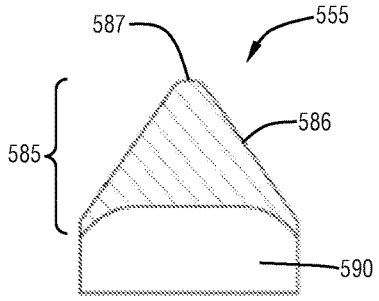
FIGS. 5 to 7 are partial cross-sectional views of non-planar cutting elements, in accordance with embodiments disclosed herein.
Figure 6:
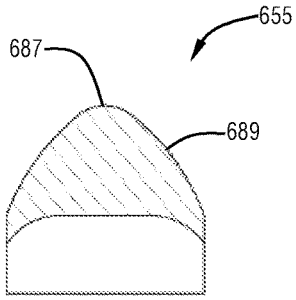
Figure 7:
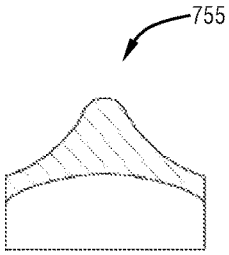

As used herein, the term "conical cutting elements" refers to cutting elements having a generally conical cutting end 585 (including either right cones or oblique cones), i.e., a conical side wall 586 that terminates in a rounded apex 587, as shown in the cutting element 555 of FIG. 5. Unlike geometric cones that terminate at a sharp point apex, the conical cutting elements of some embodiments of the present disclosure possess an apex 587 having curvature between the side surfaces and the apex. Further, in one or more embodiments, a bullet cutting element 655 may be used. The term "bullet cutting element" refers to a cutting element having, instead of a generally conical side surface, a generally convex side surface 689 terminating at a rounded apex 687. In one or more embodiments, the apex 687 has a substantially smaller radius of curvature than the convex side surface 689. Both conical cutting elements and bullet cutting elements are "pointed cutting elements," having a pointed end that may be rounded. It is also intended that the non-planar cutting elements of the present disclosure may also include other shapes, including, for example, a pointed cutting element may have a concave side surface terminating in a rounded apex, as shown by the cutting element 755 of FIG. 7.

Figures 1, 8:
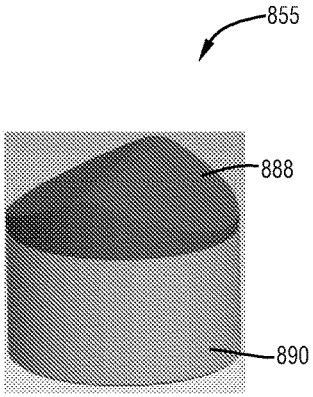
Figures 2, 8:
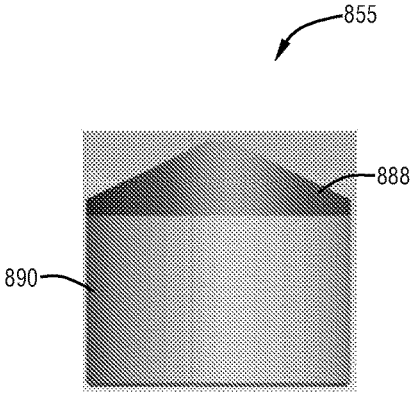
Figure 9:
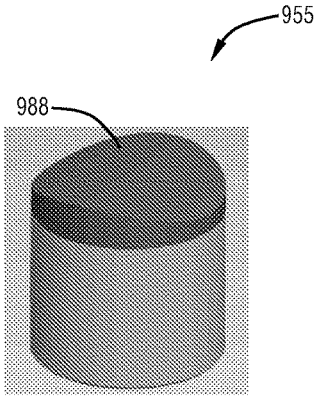
FIG. 9 is a perspective view of another ridge cutting element, in accordance with embodiments disclosed herein.

The term "ridge cutting element" refers to a cutting element that is generally cylindrical having a cutting crest (e.g., a ridge or apex) extending a height above a substrate (e.g., substrate 590 of FIG. 5), and at least one recessed region extending laterally away from the crest. An embodiment of a ridge cutting element 855 is depicted in FIGS. 8-1 and 8-2, where the cutting element top surface 888 has a parabolic cylinder shape and is coupled to a substrate 890. Variations of the ridge cutting element may also be used, and for example, while the recessed region(s) may be shown as being substantially planar, the recessed region(s) may also be convex or concave. While the crest is shown as extending substantially linearly along its length, it may also be convex or concave and may include one or more peaks and/or valleys, including one or more recessed or convex regions (e.g., depressions in the ridge). In some embodiments, the ridge cutting element may have a top surface that has a reduced height between two cutting edge portions, thereby forming a substantially saddle shape or hyperbolic paraboloid (e.g., top surface 988 of the cutting element 955 of FIG. 9).

Figures 1, 10:
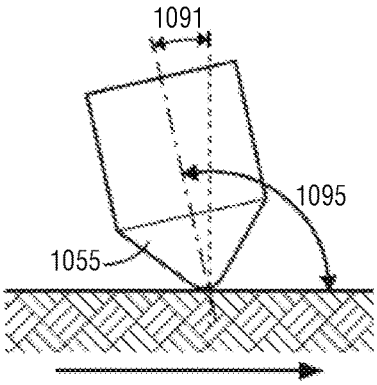
Figures 2, 10:
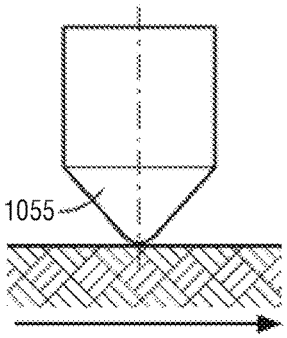
Figures 3, 10:
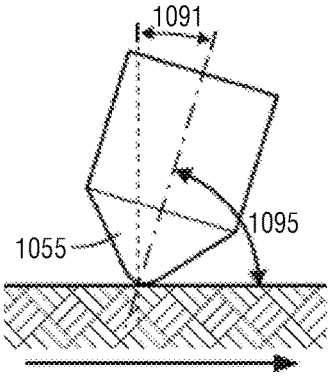

Orientations of planar cutting elements (or shear cutting elements) on an underreamer are known in the art, and may be referenced using terms such as "side rake" and "back rake." While non-planar cutting elements may be described as having a back rake and side rake in a similar manner as planar cutting elements, non-planar cutting elements may not have a cutting face or may be oriented differently (e.g., out from a formation facing surface rather than toward a leading edge), and thus the orientation of non-planar cutting elements should be defined differently. When considering the orientation of non-planar cutting elements, in addition to the vertical or lateral orientation of the cutting element body, the non-planar geometry of the cutting end also affects how and the angle at which the non-planar cutting element strikes the formation. Specifically, in addition to the back rake affecting the aggressiveness of the interaction of the non-planar cutting element with the formation, the cutting end geometry (specifically, the apex angle and radius of curvature) greatly affect the aggressiveness that a non-planar cutting element attacks the formation. In the context of a pointed cutting element, as shown in FIGS. 10-1 to 10-3 (collectively FIG. 10), back rake is defined as the angle 1091 formed between the axis of the pointed cutting element 1055 (specifically, the axis of the pointed cutting end) and a line that is normal to the formation or other material being cut. As shown in FIG. 10-2, with a pointed cutting element 1055 having zero back rake, the axis of the pointed cutting element 1055 is substantially perpendicular or normal to the formation material. As shown in FIG. 10-3, a pointed cutting element 1055 having negative back rake angle 1091 has an axis that engages the formation material at an angle 1095 that is less than 90° as measured from the formation material. Similarly, a pointed cutting element 1055 having a positive back rake angle 1091 as shown in FIG. 10-1 has an axis that engages the formation material at an angle that is greater than 90° when measured from the formation material. In some embodiments, the back rake angle 1091 of the pointed cutting elements may be zero, or in some embodiments may be negative. In some embodiments, the back rake of the pointed cutting elements 1055 may be between −20° and 20°, between −10° and 10°, between 0° and 10°, or between −5° and 5°.

Figure 11:
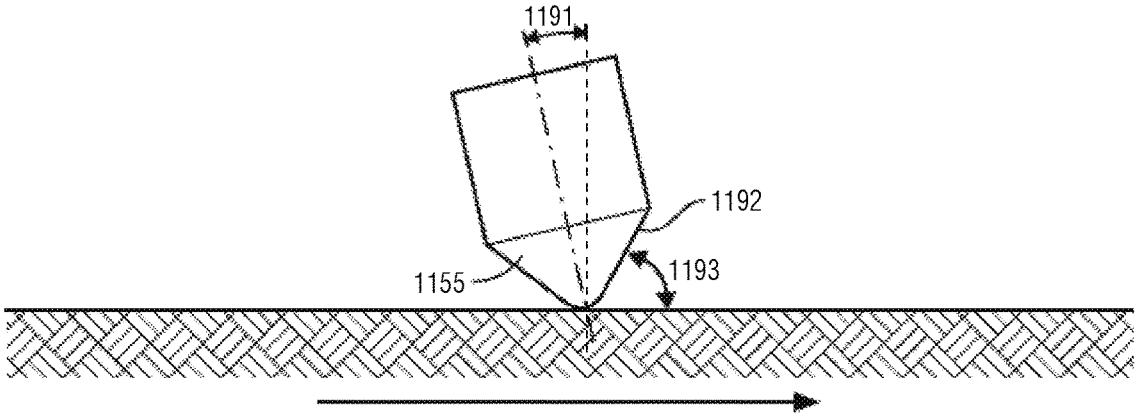
FIG. 11 is a side view of a cutting element having a strike angle, in accordance with embodiments disclosed herein.

In addition to the orientation of the axis with respect to the formation, the aggressiveness of pointed or other non-planar cutting elements may also be dependent on the apex angle or specifically, the angle between the formation and the leading portion of the non-planar cutting element. Because of the cutting end shape of the non-planar cutting elements, there does not exist a leading edge as found in a planar/shear cutting element; however, the leading line of a non-planar cutting surface may be determined to be the first points of the non-planar cutting element at each axial point along the non-planar cutting end surface as the attached body (e.g., body of an underreamer cutting block) rotates around a tool axis. Said in another way, a cross-section may be taken of a non-planar cutting element along a plane in the direction of the rotation of the tool, as shown in FIG. 11. The leading line 1192 of the pointed cutting element 1155 in such plane may be considered in relation to the formation. The strike angle of a pointed cutting element 1155 is defined to be the angle 1193 formed between the leading line 1192 of the pointed cutting element 1155 and the formation being cut. The angle 1193 may be affected by the geometry of the cutting element 1155, the back rake angle 1191, or other factors.

For polycrystalline diamond compact cutting elements (e.g., shear cutters), side rake is conventionally defined as the angle between the cutting face and the radial plane of the downhole tool (x-z plane). Non-planar cutting elements do not, however, have a planar cutting face and thus the orientation of pointed cutting elements should be defined differently. In the context of a non-planar cutting element such as the pointed cutting elements 1255, shown in FIGS. 12-1 to 13-3, side rake is defined as the angle 1294 formed between the axis of the cutting element 1255 (specifically, the axis of the conical cutting end in the illustrated embodiment) and a line perpendicular to the tool or cutter block centerline. Side rake may be defined in other manners. For instance, side rake could be defined as an angle formed between the axis of the cutting element 1255 and a line perpendicular to the tangent of the profile of the cutter block at the location of the cutting element. In FIGS. 12-1 to 13-3, the z-axis may represent the line perpendicular to the tool centerline or the line perpendicular to the tangent of the cutter block profile.

Figures 1, 12:
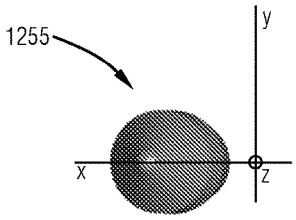
Figures 2, 12:
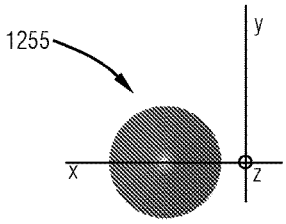
Figures 3, 12:
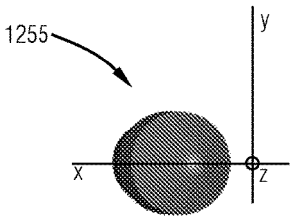
Figures 1, 13:
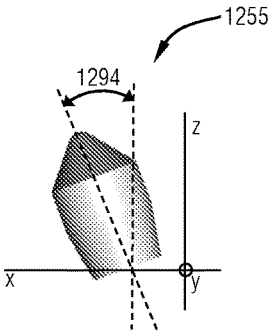
Figures 2, 13:
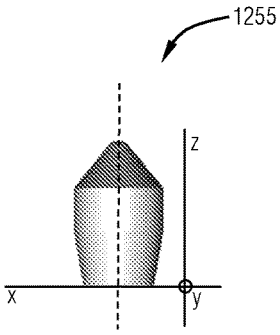
Figures 3, 13:
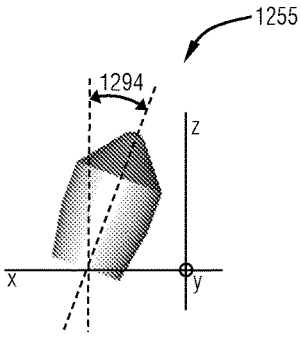

As shown in FIGS. 12-2 and 13-2, with a pointed cutting element 1255 having zero side rake, the axis of the pointed cutting element 1255 is substantially parallel to the z-axis. A pointed cutting element 1255 having negative side rake angle 1294, as shown in FIGS. 12-1 and 13-1 has an axis that is pointed away from the direction of the tool centerline.

Conversely, a pointed cutting element 1255 having a positive side rake angle 1294 as shown in FIGS. 12-3 and 13-3 has an axis that points toward the direction of the tool centerline. The side rake of the pointed cutting elements 1255 may range between −30° and 30°, between −10° and 10°, or between −5° and 5° in some embodiments. Further, the side rake angle 1294 of the non-planar cutting elements in embodiments of the present disclosure may be selected from these ranges. In some embodiments, leading cutting elements and trailing cutting elements may have the same or different side rake angles and/or back rake angles. For instance, a leading cutting element may have a positive back rake angle between 15° and 20° while a trailing or back-up cutting element may have a positive back rake angle of between 7° and 15°. In some embodiments, the side rake angle 1294 relative to the profile of the cutter block may be between −5° and 5°.

It should be understood that while elements are described herein in relation to depicted embodiments, each element may be combined with other elements of other embodiments. For example, any or each of the conical cutting elements 355 of FIGS. 3-1 to 3-3 may be replaced by planar cutting elements or even other non-planar cutting elements as described herein.

While embodiments of underreamers and cutter blocks have been primarily described with reference to wellbore enlargement operations, the devices described herein may be used in applications other than the drilling or enlargement of a wellbore. In other embodiments, underreamers and cutter blocks according to the present disclosure may be used outside a wellbore or other downhole environment used for the exploration or production of natural resources. For instance, tools and assemblies of the present disclosure may be used in a wellbore used for placement of utility lines, or other industries (e.g., aquatic, manufacturing, automotive, etc.). Accordingly, the terms "wellbore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where a range of values includes various upper and/or lower limits, any two values may define the bounds of the range, or any single value may define an upper limit (e.g., up to 50%) or a lower limit (at least 50%).

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. It should be understood that "proximal," "distal," "uphole," and "downhole" are relative directions. As used herein, "proximal" and "uphole" should be understood to refer to a direction toward the surface, rig, operator, or the like. "Distal" or "downhole" should be understood to refer to a direction away from the surface, rig, operator, or the like.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A cutting apparatus, comprising:

a cutter block having a formation facing surface, a leading edge on a first side of the formation facing surface, and a trailing edge on a second side of the formation facing surface opposite the first side of the formation facing surface, wherein the leading and trailing edges are each configured to engage a reamer body and the formation facing surface comprises a width; and a plurality of cutting elements coupled to the formation facing surface of the cutter block, extending outwardly from the formation facing surface of the cutter block, and arranged in a plurality of rows that are oriented at angles between 35° and 55° relative to a longitudinal axis of the cutter block between the leading edge and the trailing edge, wherein a first length between cutting elements on opposite ends of at least one row of the plurality of rows is greater than the width of the formation facing surface.

2. The apparatus of claim 1, wherein each row of the plurality of rows is oriented at the same angle between 35° and 55° relative to the longitudinal axis of the cutter block.

3. The apparatus of claim 1, the first length of the at least one row of the plurality of rows of cutting elements is between 65% and 85% of an effective width extending parallel to the at least one row substantially a distance of the formation facing surface from the leading edge to the trailing edge.

4. The apparatus of claim 1, a second length of a second row of the plurality of rows of cutting elements is between 25% and 45% of an effective width extending parallel to the second row substantially a distance of the formation facing surface from the leading edge to the trailing edge.

5. The apparatus of claim 1, the rows of cutting elements being located in an underreaming portion of the cutter block.

6. The apparatus of claim 1, the rows of cutting elements being located in a backreaming portion of the cutter block.

7. The apparatus of claim 1, the plurality of cutting elements being a first plurality of cutting elements, the apparatus further comprising:

a plurality of second cutting elements coupled to the formation facing surface of the cutter block and arranged in rows that are about parallel to the longitudinal axis of the cutter block.

8. The apparatus of claim 1, the cutting elements including non-planar cutting elements.

9. The apparatus of claim 1, the cutting elements being arranged to provide leading and back-up cutting element positions.

10. A cutting apparatus, comprising:

a cutter block having:

a formation facing surface;

a leading edge on a first side of the formation facing surface, wherein the first side is configured to engage a reamer body;

a trailing edge on a second side of the formation facing surface opposite the first side of the formation facing surface, wherein the second side is configured to engage the reamer body; and at least one mud flute in the formation facing surface and extending at least partially between the leading edge and the trailing edge, wherein the at least one mud flute extends from at least one of the leading edge or the trailing edge; and a plurality of cutting elements coupled to the formation facing surface of the cutter block and extending in an angled row that is parallel to the at least one mud flute.

11. The apparatus of claim 10, the at least one mud flute being positioned between rows of the plurality of cutting elements.

12. The apparatus of claim 10, the at least one mud flute being at an angle between 35° and 50° relative to a longitudinal axis of the cutter block.

13. The apparatus of claim 10, the at least one mud flute including a plurality of generally parallel mud flutes.

14. The apparatus of claim 10, the at least one mud flute being located in an underreaming portion of the cutter block.

15. The apparatus of claim 10, the at least one mud flute extending fully between the leading edge and the trailing edge.

16. A downhole cutting apparatus, comprising:

an expandable cutter block having:

a formation facing surface;

leading and trailing edges on opposite sides of the formation facing surface, wherein the leading and trailing edges each comprise a plurality of splines configured to engage corresponding splines of a reamer body; and a plurality of angled mud flutes in the formation facing surface and extending between the leading and trailing edges;

a plurality of cutting elements coupled to the formation facing surface and arranged in at least three angled rows each including at least four non-planar cutting elements extending outwardly from the formation facing surface, at least two of the plurality of angled mud flutes being positioned between the at least three angled rows; and at least one reinforcement member coupled to the leading edge and aligned with a gauge portion of the formation facing surface.

17. The apparatus of claim 16, the at least one reinforcement member being aligned with a gauge portion of the formation facing surface and including at least one diamond enhanced insert having a rounded top and at least one planar cutting element.

18. The apparatus of claim 17, further comprising:

one or more gauge protection elements coupled to a gauge pad of the gauge portion.

19. The apparatus of claim 17, the gauge portion including an asymmetric gauge pad.

20. The apparatus of claim 16, the formation facing surface defining an underreaming portion, a backreaming portion, and a gauge pad between the underreaming portion and the backreaming portion, the at least three angled rows and the plurality of angled mud flutes being located on the underreaming portion, and the plurality of cutting elements including at least two longitudinal rows of cutting elements that are about parallel to a longitudinal axis of the expandable cutter block.

* * * * *